US005251516A

United States Patent [19]

Desaulniers

[11] Patent Number: 5,251,516

[45] Date of Patent: Oct. 12, 1993

[54] TOOL FOR EXTRACTING BROKEN BOLTS AND THE LIKE

[75] Inventor: Donald J. Desaulniers, Wolcott, Conn.

[73] Assignee: Alden Corporation, Wolcott, Conn.

[21] Appl. No.: 10,370

[22] Filed: Jan. 28, 1993

Related U.S. Application Data

[63] Continuation-in-part of Ser. No. 791,374, Nov. 14, 1991, abandoned.

[51] Int. Cl.[5] ..... B25B 13/50

[52] U.S. Cl. ..... 81/53.2; 7/158

[58] Field of Search ..... 81/53.2, 459; 7/158, 7/165

[56] References Cited

U.S. PATENT DOCUMENTS

| | | | |
|---|---|---|---|
| 2,062,383 | 12/1936 | West | 81/459 X |
| 2,641,948 | 6/1953 | Braendel | 81/53.2 |
| 5,031,487 | 7/1991 | Polonsky | 81/53.2 |

*Primary Examiner*—James G. Smith
*Attorney, Agent, or Firm*—Dallett Hoopes

[57] ABSTRACT

The tool includes a central section having a left-hand drill bit section at one end and an extraction section at the other. The extraction section tapers toward its distal end and is formed with left-hand threads on the exterior of the taper. The distal end is chamfered at an angle more abrupt than the taper so that the chamfer intercepts the threads and so that the threads rise outward in a short axial distance and are able to bite into the margins of a shallow hole drilled in the bolt remnant by the bit section.

7 Claims, 5 Drawing Sheets

TOOL FOR EXTRACTING BROKEN BOLTS AND THE LIKE

CROSS REFERENCE TO RELATED APPLICATIONS

This application is a continuation-in-part of application 791,374 filed Nov. 14, 1991 abandoned.

BACKGROUND OF THE INVENTION

1. Field of the Invention

This invention relates to a tool for extracting broken bolts, screws and the like. More specifically, this invention relates to a single-piece tool adapted to be installed in the chuck of a counter-clockwise rotating drill to extract broken bolts, screws and the like.

2. Description of Related Art including Information Disclosed under §1.97 to 1.99

The prior art discloses a number of threaded devices for removing broken bolts or studs. For instance, the old Pat. No. 1,105,535 which issued Jul. 28, 1914 to J. O. Roberts discloses merely a steeply pitched left-hand auger bit adapted to be inserted into a hole separately drilled in the broken bolt. The bit is turned counter-clockwise to remove the broken bolt.

Pat. No. 2,062,383 which issued Dec. 1, 1936 to M. A. West discloses a double-ended tool having threads of opposite hand on its respective ends. The reaming and removing end bas a beveled tip and the driving end has a flat tip. Both ends operate in the recess of a special screw.

Pat. No. 2,281,164 which issued Apr. 28, 1942 to H. S. Maling discloses a right-hand threaded sleeve adapted to be screwed into the hole of the broken bolt, the sleeve having a left-hand threaded bore into which a threaded mandrel is screwed, the mandrel having teeth or nibs on its bottom to dig into the bolt remnant so that the remnant is removed as the sleeve is unscrewed.

Pat. No. 2,684,606 which issued Jul. 27, 1954 to J. A. Brawley provides a left-hand self-threading tap adapted to be screwed into a hole drilled into a bit remnant. A locknut is provided to connect integrally the tap and the remnant. The tap is turned to remove the remnant.

A screw extractor in the Berendzen 4,078,458 which issued Mar. 14, 1978 discloses a drill on the end of a tapered threaded cone whereby a hole can be drilled in the remnant and, drilling farther, the cone can engage the margins of the hole to spin the remnant out of its threaded hole.

More recently a number of meritorious patents have issued to Eli Polonsky in which a left-hand drill bit is provided with a gripping fixture on its stem, and adapted to bite into the hole made by the drill so that the remnant may be removed in a single operation as the device is turned counter-clockwise. The Polonsky patents now assigned to my assignee are:

| |
|---|
| 4,604,917 which issued August 12, 1986 |
| 4,777,850 which issued October 18, 1988 |
| 5,031,487 which issued July 16, 1991 |

Most of the previous extractor techniques involve first drilling a hole into the remnant and then inserting some form of extractor which engages the drilled hole thereby allowing the remnant to be rotated out of its bore.

Problems can arise with this technique. First, by drilling a hole into the broken remnant, the remnant itself is weakened. A sufficient amount of the broken bolt must remain to give the extractor material to grab in order to transmit a rotational force to remove it. Second, the extractor must be able to fit inside the previously drilled hole. This means that the extractor portion that engages the remnant must be smaller than the remnant itself so that it can fit into this drilled hole. Since the extractor must be smaller than the remnant, a potential for breakage of the extractor is high. The most common cause of dissatisfaction with the previous extraction methods is breakage of the tool when attempting an extraction.

Therefore, an optimum tool for extracting broken bolts must 1. drill a hole as small in diameter as possible so as not to break the wall on the screw,
2. have an extractor as large as possible so as not to break the extractor,
3. drill a hole as shallow as possible and still give enough depth to work. Shallowness is a virtue because the broken part is invariably hard and drilling in it takes valuable time of the mechanic.

None of the previous extractors address the importance of keeping the drilled hole as shallow as possible and the extractor as large as possible.

My extractor addresses all of the above requirements. First, it offers a drill that is optimally sized for a particular application, that is, particular size remnant. Second, it offers an extractor that is as strong as possible for the bore drilled by the drill. Third, it is structured to engage a broken bolt with the shallowest hole drilled into the remnant.

SUMMARY OF THE INVENTION

The present invention relates to an improved product which is remarkably efficient in removing broken bolt remnants and is sufficiently strong to remove the most stubborn remnant from its bore.

Throughout, the invention will be described in a form suited for extracting right-hand bolt remnants. It will be understood to those even unskilled in the art that to work with a remnant of left-hand thread, the opposite hand of drill and extractor section from those described herein is used.

The invention, therefore, is a tool for extracting broken bolts comprising a central section having a plurality of flat longitudinal surfaces adapted to be engaged by a drill chuck. At one end of the central section there is provided a left-hand drill bit, the bit having a drilling head of a certain drilling diameter and being necked in intermediate the central section and the head.

At the opposite end from the bit section the central section is provided with an extraction section tapering toward its distal end and being formed with left-hand threads on the exterior of the taper, the distal end being chamfered at an angle more abrupt than the angle of the tapered portion and intersecting the threads to be flush with the root of the threads at a first diameter adjacent the beginning of the chamfer and flush with the crest of the threads at a second diameter farther along the chamfer outward of the first diameter to form gradually rising threads, the length of the drilling diameter being intermediate the lengths of the first and second effective diameters.

BRIEF DESCRIPTION OF THE DRAWINGS

Other features and objects of the invention will be apparent to those skilled in the art after a study of the following specification, including reference to the appended drawings, all of which show a non-limiting embodiment of the invention. In the drawings.

DESCRIPTION OF THE PREFERRED EMBODIMENTS

Figure 1:
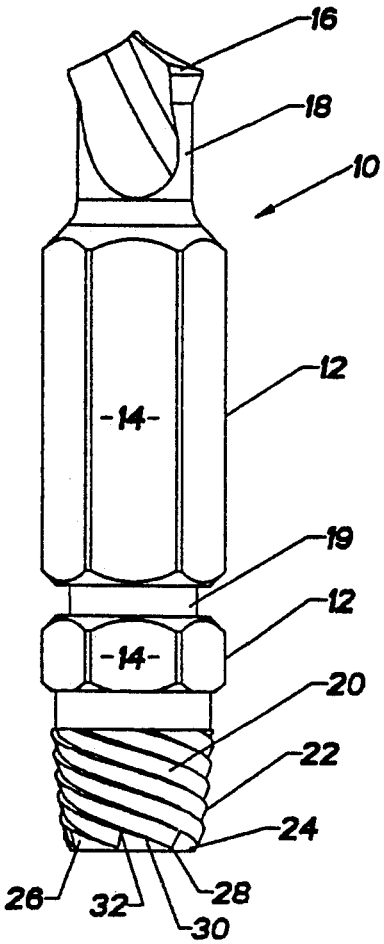
FIG. 1 is a front elevational view.
Figure 3:
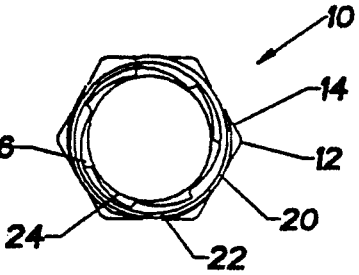
FIG. 3 is a bottom view.

A tool embodying the invention is shown in FIG. 1 and generally designated 10. It comprises a central section 12 having a plurality of flat longitudinal surfaces 14 adapted to be engaged by a drill chuck. The section 12 of the FIG. 1 embodiment is hexagonal in cross section.

At the upper end of the central section 12 shown in FIG. 1 there is provided a left-hand drill bit 16 having a certain drilling diameter and being necked in as at 18 intermediate the central section 12 and the head 16.

Adjacent its lower end the central section 12 may be reduced at 19 to form a break-away zone.

Figure 10:
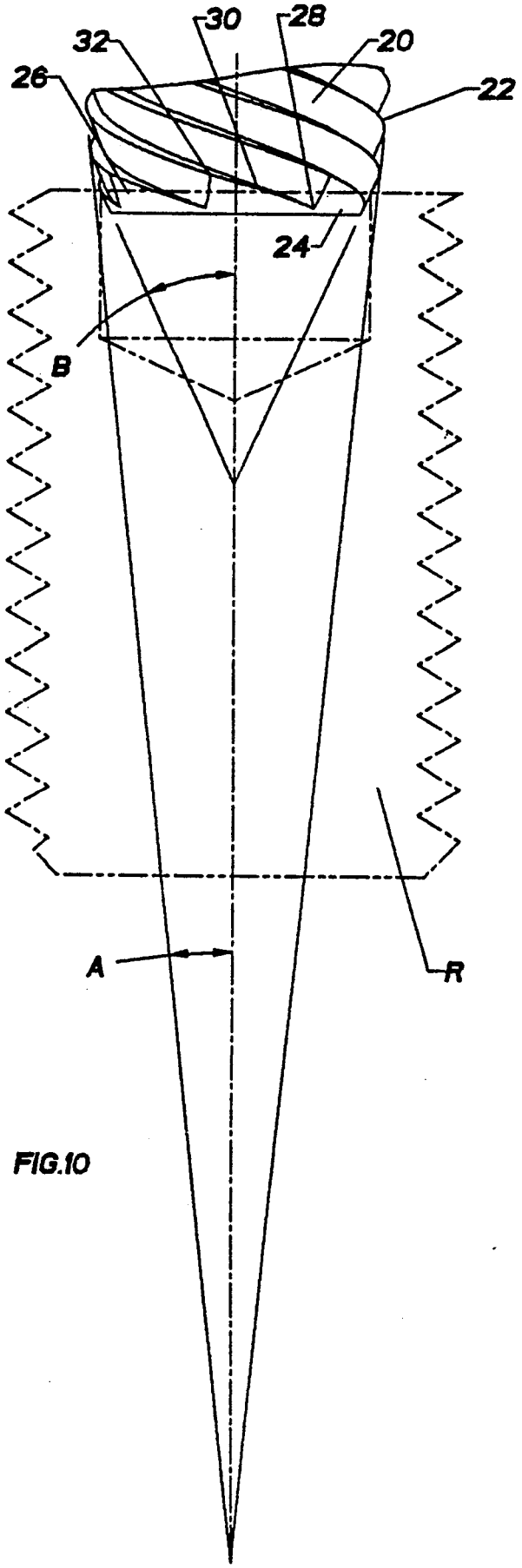
FIG. 10 is an enlarged schematic view demonstrating the angular disposition of the taper and the chamfer of the extraction section.

At the lower end of the central section 12 in FIG. 1 is an extraction section 20 which is tapered, narrowing toward its distal end; that is, the end not connected to the central section 12. The taper is at an angle A (FIG. 10) to the axis of the tool in a range of from 3° to 9° and is preferably about 6°. The tapered extraction section is formed with left-hand threads 22 on the exterior of the taper as shown.

The distal end of the threaded taper is formed with a peripheral chamfer 24. The chamfer is formed at an angle B (FIG. 10) to the axis of the tool in a range of 15° to 35°, preferably about 25°.

Figure 11:
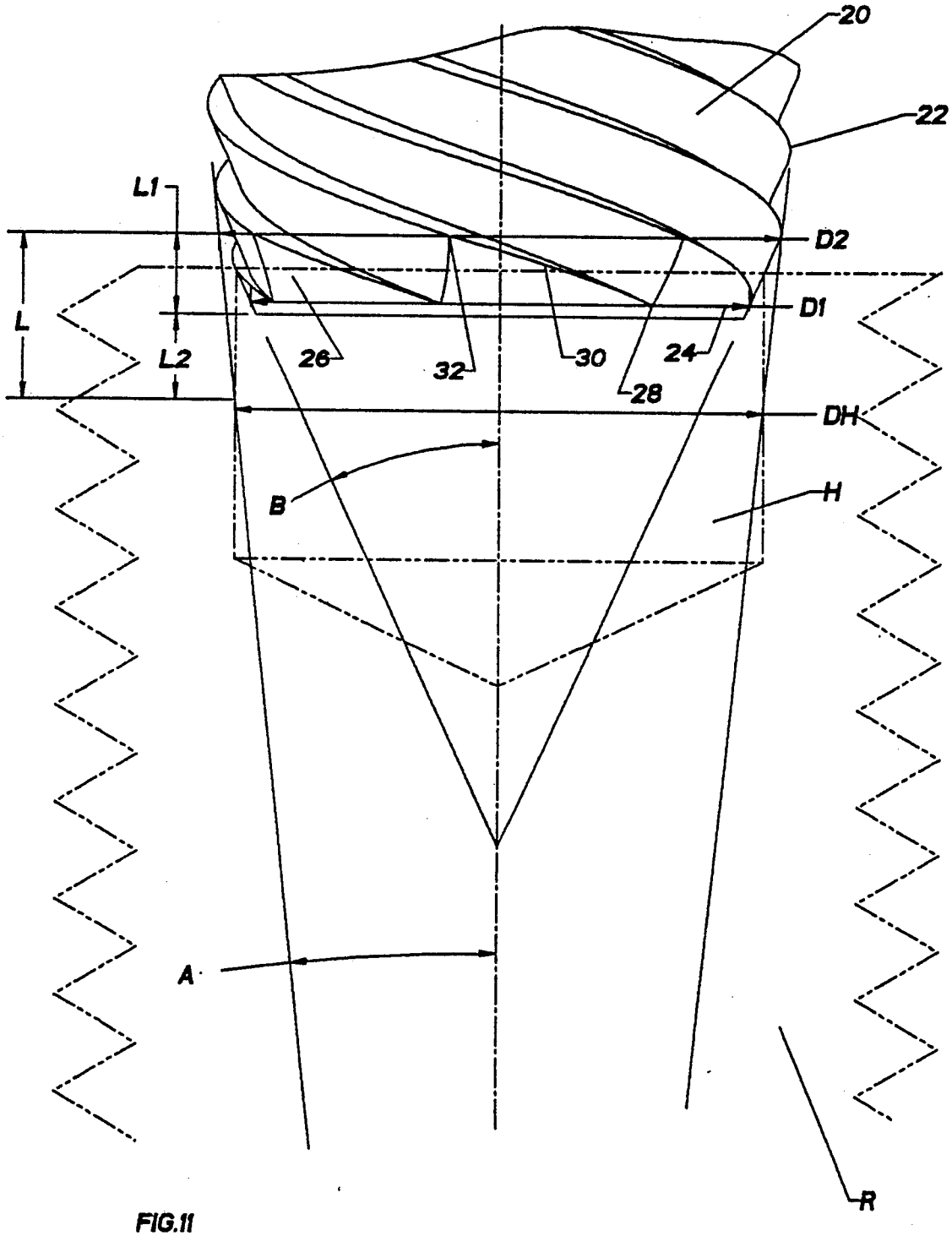
FIG. 11 is an enlarged view schematically showing the engagement of the rising threads with the margin of a drilled hole in a remnant.

The chamfer 24 intersects the threads on the taper. Close to the tip of the extraction section the chamfer will be flush with the roots 28 of the threads at a first diameter $D_1$ (FIG. 11). Farther up and outward from the axis the chamfer will be flush with the crest 32 of the threads at a second effective diameter $D_2$. The term "effective" is used because the threads may not be diametrically opposite; i.e. there may be an odd number of threads. Hence, "effective diameter" means the diameter of the crest circle at the described level. Hereafter it will simply be called the "second diameter". Inbetween the first diameter and the second diameter the intersection of the chamfer and the threads produce gradually rising threads.

The nature of the rising threads can be better understood from reference to FIGS. 4–4*d* and FIG. 5 through 5*d* and FIG. 9.

Figure 2:
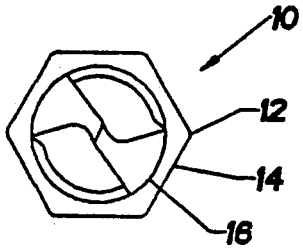
FIG. 2 is a top view.
Figure 4:
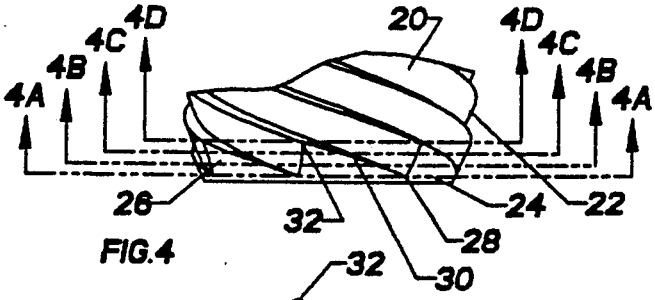
FIG. 4 is an enlarged fragmentary view of the distal end of the extraction section showing the locator tip.
Figure 4D:
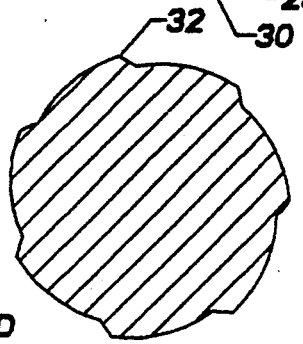
FIG. 4*d* is a sectional view taken on the line 4–4*d* of FIG. 4.
Figure 4C:
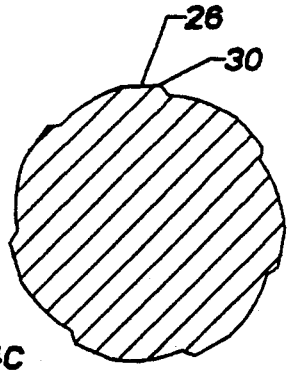
FIG. 4*c* is a sectional view taken on the line 4–4*c* of FIG. 4.
Figure 4B:
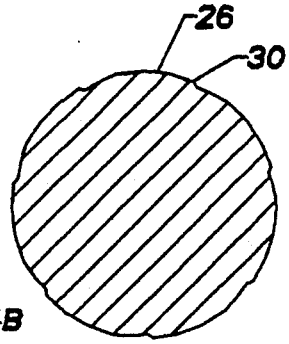
FIG. 4*b* is a sectional view taken on the line 4–4*b* of FIG. 4.
Figure 4A:
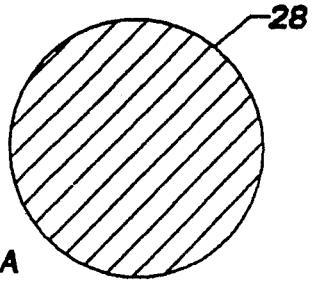
FIG. 4*a* is a sectional view taken on the line 4–4*a* of FIG. 4.

Referring to FIG. 4, the various sections show that the chamfer is flush in FIG. 4*a* with the root of the thread. Moving upward, FIGS. 4*b*, 4*c* and 4*b* progressively show a thread rising along edge 30 to the crest 32 in FIG. 4*d*. It will be clear that the sections FIG. 4*a* and FIG. 4*d* include the first and second diameters as explained above.

Figure 5:
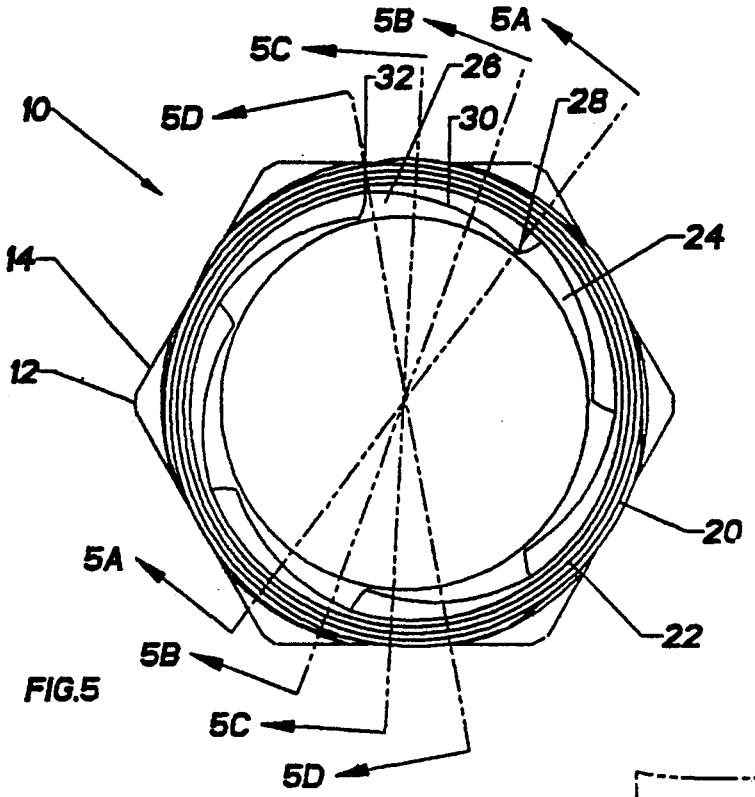
FIG. 5 is a greatly enlarged bottom view.
Figure 5D:
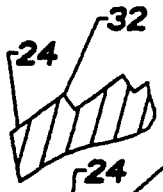
FIG. 5*d* is a fragmentary sectional view taken above the axis on the line 5*d*—5*d* of FIG. 5.
Figure 5C:
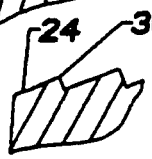
FIG. 5*c* is a fragmentary sectional view taken above the axis on the line 5*c*—5*c* of FIG. 5.
Figure 5B:
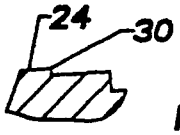
FIG. 5*b* is a fragmentary sectional view taken above the axis on the line 5*b*—5*b* of FIG. 5.
Figure 5A:
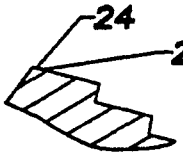
FIG. 5*a* is a fragmentary sectional view taken above the axis on the line 5*a*—5*a* of FIG. 5.

FIGS. 5–5*d* show the growing thread as it progresses peripherally about the extraction section from the plane of the first diameter, explained above, whereat the rising edge 30 (FIG. 5*a*) is non-existent. The growth of that edge can be discerned comparing progressively FIGS. 5*b* through 5*d*. In the latter FIG. the edge is at the crest 32, fully developed.

Figure 9:
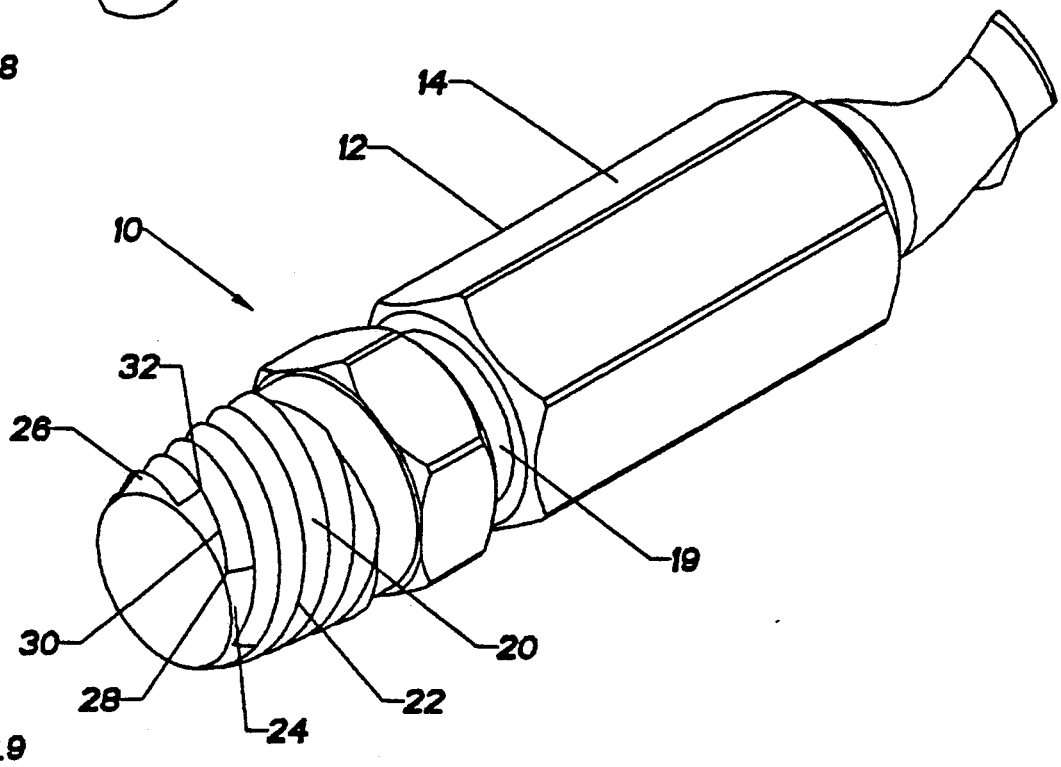
FIG. 9 is a perspective view taken from adjacent the extraction section.

FIG. 9 shows especially well the inner section of the peripheral chamfer with the threads on the taper. It will be noted that the chamfer 24, as it intersects the threads, permits the development of the edge 30 or gradually rising threads up to the crest 32.

FIG. 11 also shows the gradually rising threads along the edge 30 at the intersection of the chamfer and the threads. The first diameter $D_1$ is clearly shown in FIG. 11 as being the diameter taken across a plane where the chamfer is flush with the root of the threads. The second diameter $D_2$, on the other hand, is taken across a plane defined by the points at which the chamfer is flush with the crests of the threads.

Figure 6:
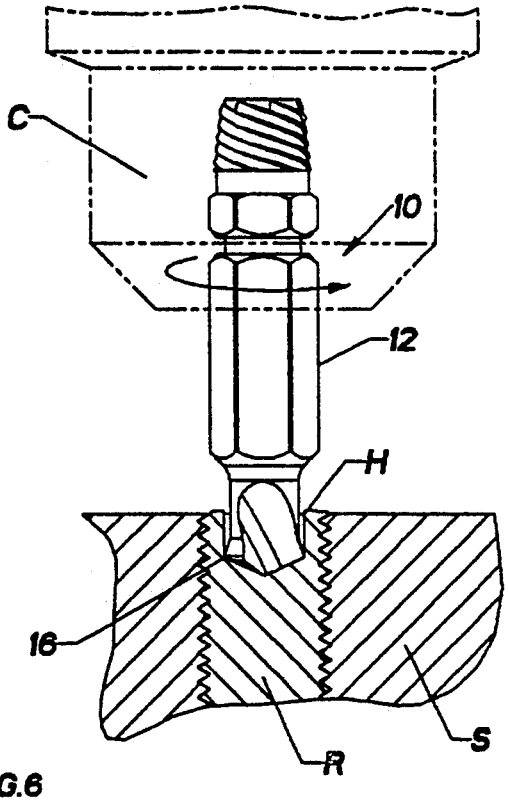
FIG. 6 is a fragmentary sectional view showing the bit of the invention in its drilling mode with a chuck shown in phantom.

In a typical situation, the broken bolt remnant R (FIG. 6) is disposed in a threaded opening in a structure S. For instance, structure S may be an engine block.

In the first phase of the extraction, the tool 10 is inserted into a chuck of a drill (FIG. 6) with the drill head 16 downward. The drill head is aligned with the center of the remnant R and brought downward as the chuck C, rotating counter-clockwise, is lowered. The chuck and tool 10 are lowered, the bit 16 drilling an axial hole H in the remnant. The chuck and bit are raised.

Figure 7:
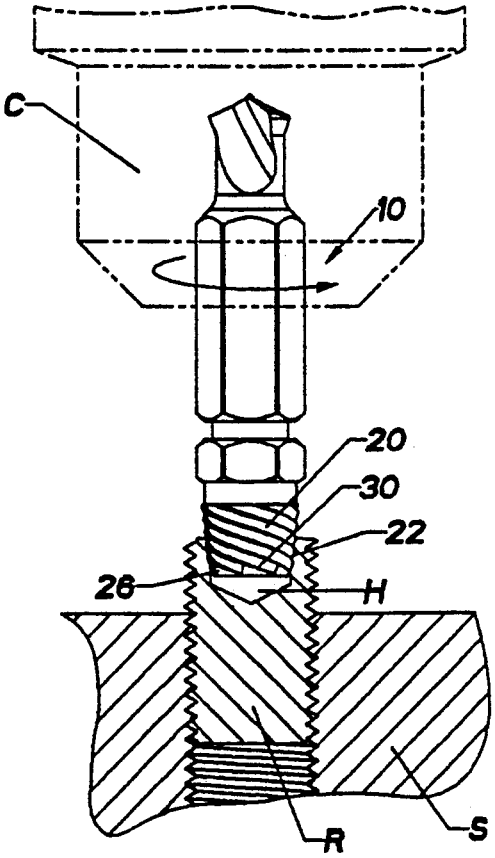
FIG. 7 is a view similar to FIG. 5 showing the tool in the extraction mode.
Figure 8:
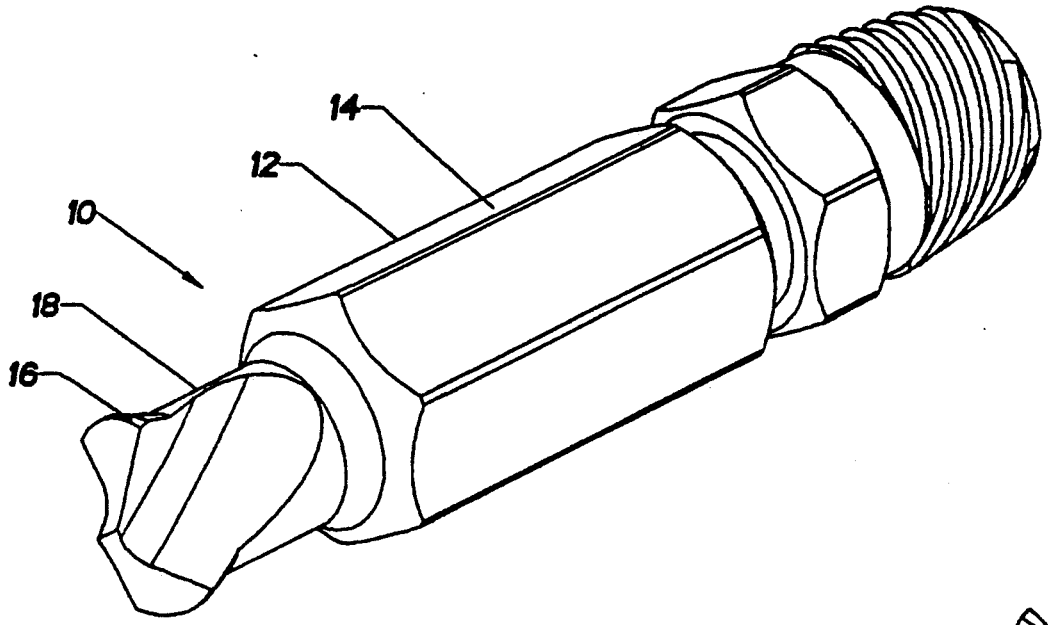
FIG. 8 is an enlarged perspective view of the tool from adjacent the bit section.

In the second phase of the operation the chuck is unlocked and the tool 10 merely inverted and reinserted in the chuck which is then locked so that the extraction section 20 is moved downward as in FIG. 7. With the chuck C rotating counter-clockwise the bit is then plunged downward so that the edge 30 of the gradually rising threads 26 engage the margins of the hole H. At this point, the gradually rising threads pull the extractor into the hole H until the extraction section 20 has sufficiently, grabbed the remnant so that the remnant rotates with the chuck C. Instantly the remnant R, the tool 10 and the counter-clockwise rotating chuck C all raise in unison, spinning the remnant out of its opening. Throughout, the chuck C is rotated in counterclockwise direction.

Because of the rising threads, the grabbing of the remnant —that is, the burrowing into the margin of the hole by the threads until the tool and remnant rotate together—is achieved in a shorter length of the threads and, therefore, the drilled hole can be shallower than if the threads were of uniform slope to the end of the taper. Further, the sizing of the drill bit to give a hole of diameter $D_H$ between $D_1$ and $D_2$ (FIG. 11) assures the most efficient combination of hole and the extractor section. Preferably the hole diameter is about halfway between the first and second diameters in length.

Illustratively, FIG. 11 shows that for the thread to be fully embedded in the margin of the hole to its full height—from root to crest—it is necessary to have a length L of uniform threads on the taper, whereas for the rising thread arrangement of the invention, its length would be only $L_1$. This means that the hole can be shallower by $L_2$. It is an arbitrary assumption, of course, that it will be necessary to fully embed the thread before the tool and remnant rotate as one, but the illustration does demonstrate the ability of the invention to work in a shallower hole.

One of the benefits of having the tool 10 unitary is that it includes a drill head 16 of exactly the right drilling dimension to assure a wall thickness in the reminant of optimum size to give it strength to survive the operation. The tool may be marked with the size of the remnant with which it is designed for use. As the same time, the extraction section 20 has its smaller end of the maximum diameter and, consequently, the optimum strength to engage the edge of hole H and perform the extraction. Thus, there is optimum cooperation between the two ends of the tool in achieving the unitary result.

The object of the operation in its most efficient version is to drill the smallest possible hole so as not to weaken the bolt walls and have the extractor as large as possible so that the tip of the extractor does not break during operation. Further, in the interest of efficiency, a hole should be shallower, as shallow as possible to achieve the task.

In the version shown the extractor tool is made from one piece of steel stock. If the drill bit must be of extreme hardness, it can be made from a carbide alloy and can be joined to the central section which can be of a more ordinary steel formulation. In making such a two-piece tool, the carbide bit is provided with a cylindrical stem and the end of the central section is formed with an axial bore to receive the stem. Once inserted, the stem is brazed or mechanically fastened to the central section 12.

It should be understood that the tool of the invention is designed to work with a portable or a stationary drill, the condition being that the drill must be run in a counter-clockwise direction.

One of the reasons for the center section being hexagonal is that when the remnant is removed and still attached to the extractor section, the broken bolt remnant may be clamped in a vice and a wrench or socket applied onto the axial central section. Turning the wrench clockwise, the tool is removed from the broken bolt and ready for reuse. Also, in the extraction process, if the drill stalls, the chuck can be opened and the drill disengaged and taken out of the way and a wrench may be used on the hexagonal shape of the central section to manually proceed with the extraction.

Also included is intermediate undercut zone 19 cut into center section 12 as shown in FIG. 1. This zone becomes a break off zone or fracture point if the tool is overtorqued. When the tool fractures at the zone 19, a portion of the center section 12 having plurality of flat longitudinal surfaces 14 remains, allowing for easy removal of the tool with a wrench or socket. In practice, the diameter of the undercut is only a few thousandths of an inch less than the diameter 28 of the extractor section where the chamfer meets the root of the threads to assure fracture at the undercut section if the tool is overtorqued. This relatively large diameter undercut re-emphasizes that the tool combines the largest possible root diameter at the beginning of the extraction section to work with the size of the bit at the other end of the tool.

The above description relates only to the preferred form of the invention. The invention is not limited to the embodiment described but is receptive to reasonable variations. The protection to which the invention is entitled, therefore, is limited only by the scope of the following claim language and such extension of the right to exclude others from making, using and selling as is appropriate under the doctrine of equivalents.

What is claimed is:

1. A tool for extracting broken bolts and the like comprise.

a. a central section having a plurality of flat longitudinal surfaces adapted to be engaged by a drill chuck, b. a left-hand bit section at one end of the central section, the bit having a drilling head to make a cylindrical drilled hole of a drilling diameter in a broken bolt, and Being necked in intermediate the central section and the head, c. an extraction section at the other end of the central section, the extraction section having a portion tapering toward its distal end and being formed with left hand threads on the exterior of the taper, the distal end being chamfered at an angle more abrupt than the angle of the tapered portion and intersecting the threads to be flush with the root of the threads at a first diameter adjacent the beginning of the chamfer and flush with the crest of the threads at a diameter farther along the chamfer outward of the first diameter to form gradually rising threads, the length of the drilling diameter being intermediate the lengths of the first and second diameters, whereby the chamfered portion of the extraction section may be inserted into the drilled hole and the threads between the first and second diameters will engage and grip the margin of the hole.

2. A tool for extracting broken bolts as claimed in claim 1 wherein the angle of the taper is in a range from 3° to 9° from the axis of the extraction section and the angle of the chamfer is in a range from 15° to 35° from the axis of the extraction section.

3. A tool for extracting broken bolts as claimed in claim 2 wherein the angle of the taper is about 6 from the axis of the extraction section and the angle of the chamfer is about 25° from the axis of the extraction section.

4. A tool for extracting broken bolts as claimed in claim 1 in which a reduced weakened zone weaker than the extraction section at the drilling diameter is formed in the central section intermediate the ends thereof so that the tool will break at the weakened zone rather than in the extraction section and a portion of the flats will remain with the extraction section for removal of the broken bolt or removal of the extraction section from the broken bolt manually.

5. A tool for extracting broken bolts as claimed in claim 1 which has a central section of a diameter less than the root diameter of the broken bolt.

6. A tool for extracting broken bolts as claimed in claim 1 wherein the diameter of the drilled hole is approximately onehalf the sum of the first and second diameters.

7. A tool for extracting broken bolts or the like comprising:

a. a central section having a plurality of flat longitudinal surfaces adapted to be engaged by a drill chuck, b. a left-hand bit at one end of the central section, the bit having a drilling he a certain drilling diameter in a broken bolt, and being necked in intermediate the central section and the head, c. an extraction section at the other end of the central section, the extraction section tapering toward its distal end and being formed with left hand threads on the exterior of the taper, the distal end having a chamfered portion intersecting the threads to form gradually rising threads, the bit diameter being equal to a diameter of the extraction section in the chamfered portion.

* * * * *